US005790916A

United States Patent [19]

Sawada

[11] Patent Number: 5,790,916

[45] Date of Patent: Aug. 4, 1998

[54] IMAGE FORMING APPARATUS AND SERVICE SYSTEM THEREFOR

[75] Inventor: Masaithi Sawada, Tokyo, Japan

[73] Assignee: Ricoh Company, Ltd., Tokyo, Japan

[21] Appl. No.: 692,255

[22] Filed: Aug. 5, 1996

[30] Foreign Application Priority Data

Aug. 7, 1995 [JP] Japan ..... 7-201168

[51] Int. Cl.[6] ..... G03G 15/00

[52] U.S. Cl. ..... 399/21; 399/8; 399/18

[58] Field of Search ..... 399/21, 18, 8; 395/182.18

[56] References Cited

U.S. PATENT DOCUMENTS

| | | | |
|---|---|---|---|
| 4,583,834 | 4/1986 | Seko et al. | 399/8 |
| 5,053,815 | 10/1991 | Wendell | 399/10 |
| 5,200,958 | 4/1993 | Hamilton et al. | 395/182.18 X |
| 5,280,322 | 1/1994 | Kono | 399/21 X |
| 5,365,310 | 11/1994 | Jenkins et al. | 399/8 |
| 5,414,494 | 5/1995 | Aikens et al. | 399/21 X |
| 5,424,808 | 6/1995 | Maekawa et al. | 399/18 |
| 5,434,650 | 7/1995 | Nakahara et al. | 399/8 |

FOREIGN PATENT DOCUMENTS

| | | |
|---|---|---|
| 0 259 144 | 9/1988 | European Pat. Off. . |
| 0 509 528 A2 | 10/1992 | European Pat. Off. . |
| 3-161763 | 7/1991 | Japan . |
| 3-293369 | 12/1991 | Japan . |
| 5-80609 | 4/1993 | Japan . |

OTHER PUBLICATIONS

Patent Abstracts of Japan, vol. 016, No. 489 (P-1433), Oct. 9, 1992, JP 4-174453, Jun. 22, 1992.

Patent Abstracts of Japan, vol. 016, No. 487 (M-1323), Oct. 9, 1992, JP 4-179654, Jun. 26, 1992.

Patents Abstracts of Japan, vol. 010, No. 388 (M-549), Dec. 25, 1986, JP 61-178371, Aug. 11, 1986.

*Primary Examiner*—Arthur T. Grimley
*Assistant Examiner*—Sophia S. Chen
*Attorney, Agent, or Firm*—Oblon, Spivak, McClelland, Maier & Neustadt, P.C.

[57] ABSTRACT

In an image forming apparatus, a plurality of paper sensors are arranged along a preselected paper transport path. A jam detecting section detects jams location by location in response to the output signals of the paper sensors. A plurality of jam alarm counters are each assigned to the respective location. Each jam alarm counter counts jam information representative of jams occurred at the respective location. When the jam alarm counter counts a preselected number of jam information, jam alarm information is generated and sent to a remote control unit via a transmitting section. However, when the count of a copy counter increases to a preselected standard jam value stored in an alarm level memory, the existing count of the jam alarm counter is reset. The apparatus is capable of accurately sending, with a small capacity memory and with a minimum of computation requirement, information showing the frequent paper jam at a particular location on the paper transport path and information showing that a paper jam will frequency occur at a particular location in the near future.

19 Claims, 9 Drawing Sheets

IMAGE FORMING APPARATUS AND SERVICE SYSTEM THEREFOR

BACKGROUND OF THE INVENTION

The present invention relates to a copier, facsimile apparatus, printer or similar image forming apparatuses using papers, and a service system for allowing a number of image forming apparatuses located at various user's stations to be maintained or repaired immediately and accurately.

A number of image forming apparatuses of the kind described are situated at user's stations belonging to various industrial fields. It is difficult to practically free the image forming apparatuses from paper jams and other troubles. The apparatuses are therefore so configured as to allow the users themselves to remove jamming papers as far as possible. However, because troubles of the kind needing a serviceman are not avoidable, each user and a manufacturer make a contract for maintenance with each other. The contract insures periodic inspection and maintenance by a serviceman as well as immediate repair in the event of a fault.

Japanese Patent Laid-Open Publication Nos. 3-293369 and 5-80609, for example, each discloses a control system in which copiers each being situated at a particular location are connected to a control unit or host computer situated at a control center via a telephone network or similar communication network. Information representative of a paper jam and other troubles are sent from the individual copier to the control unit. This allows a single control unit to remote control all the copiers.

Specifically, in the control system disclosed in Publication No. 3-293369, each copier detects and counts paper jams location by location. Every time a jam occurs and every time a paper is driven out of the copier, the copier computes a jam frequency (maximum and minimum values, mean value, mean of deviations, etc.) occurred during the latest preselected number of times of copying (e.g. 1,000 times). When the jam frequency exceeds a location-by-location allowable value, the copier sends alarm data or similar data for control and indicative of the unusual jam frequency to the control unit via the telephone network.

Therefore, the control center can see the unusual jam frequency immediately and take an adequate measure, e.g., sending a serviceman.

Also, the copier taught in Publication No. 5-80609 detects a jam or similar transport error location by location during image forming sequence while storing it. When, for example, a transport error occurs before a preselected number of copies are produced or within a preselected time interval or when transport errors of the same kind occur continuously, the stored error information is sent to a host computer situated at a control center via a public telephone network. This allows the operator at the control center to see the feed error information on, e.g., a display.

The conventional copiers and control systems therefor described above have some problems yet to be solved, as follows. Each copier simply stores paper jam information and other error information therein while the associated control unit simply receives the information from the copier and informs the operator via, e.g., a display. The operator therefore must make a decision on an error or estimate it based on the received information, and must determine whether or not to send a serviceman. When a serviceman is needed, the operator must request a serviceman at a service station to make a visit on a telephone or a facsimile apparatus while informing him of the copier in question and the conditions of the same.

Moreover, when all kinds of information are sent from each copier to the service station, the operator must determine whether each information is fatal information leading to a fault or whether it is a simple report of a condition. This not only results in time- and labor-consuming work but also increases the communication cost. Should the information to be sent from the copier to the control and their timings be extremely limited, it would be impossible for the operator to predict a fault or to estimate the need for a serviceman dispatch (remote analysis).

The control system taught in Laid-Open Publication No. 3-293369 is expensive because a great number of signals are used to execute jam control in each copier and because a memory having a capacity great enough to store a preselected number of jam information and their statistical values. In addition, statistical computations are complicated and time-consuming. As a result, the copying speed of the copier is apt to fall.

In the copier taught in Laid-Open Publication No. 5-80609, when a jam or similar transport error occurs twice before a preselected number of copies are produced or within a preselected time interval during image forming sequence or when transport errors of the same kind occur twice, the resulting information is sent to the control unit or host computer. In the other cases, the transport error information detected and stored before are simply cancelled. Therefore, if the above interval is long, then most of transport error information representative of minor transport errors are also sent to the control unit. If the interval is short, then most of transport information are stored, but cancelled afterwards. With this kind of scheme, it is impossible to send only valid information for the decision as the a serviceman dispatch to the control unit.

SUMMARY OF THE INVENTION

It is therefore an object of the present invention to provide an image forming apparatus capable of sending, with a relatively small capacity memory and a minimum of computation requirement, information representative of frequent paper jam at any particular location and information showing that a jam will frequently occur at any particular location in the near future to a control unit accurately.

It is another object of the present invention to provide an image forming apparatus service system in which a control unit is capable of automatically sending, when estimation information received from any copier indicates the need for a serviceman, necessary information to a service station covering the apparatus in question.

In accordance with the present invention, an image forming apparatus has a plurality of sensors each being located at a particular location on a preselected paper transport path. A jam detecting section detects a paper jam during image formation location by location on the basis of output signals of the sensors. A plurality of storages are each assigned to a particular location, and each stores a standard jam value corresponding to the number of papers undergone image formation to thereby determine whether or not jam information is valid. A plurality of paper counters are each assigned to a particular location, and each counts a number of papers continuously undergone image formation without any paper jam. A plurality of jam alarm counters are each assigned to a particular location. Each jam alarm counter counts, when the jam detecting section detects a paper jam occurred at a location and if the count of associated one of the paper counters is smaller than the standard jam value assigned to the location, resulting jam information. Each jam alarm counter resets the count of jam information when the count of the paper counter reaches the standard jam value assigned to the location before the next paper jam is detected at the location. Further, each jam alarm counter generates, when the count of jam information reaches a preselected reference value, jam alarm information showing that a paper jam will frequently occur at the location in the near future. A jam alarm information transmitting section transmits jam alarm information generated by the plurality of jam alarm counters to a control unit connected to the apparatus by a communication line.

Also, in accordance with the present invention, in an image forming apparatus service system, a plurality of image forming apparatuses each having the above construction are each situated at a particular user's station and connected to a control unit by a communication network for remote control. The control unit is connected by a communication network to a plurality of terminal units each being situated at a particular service station.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENT

Figure 2:
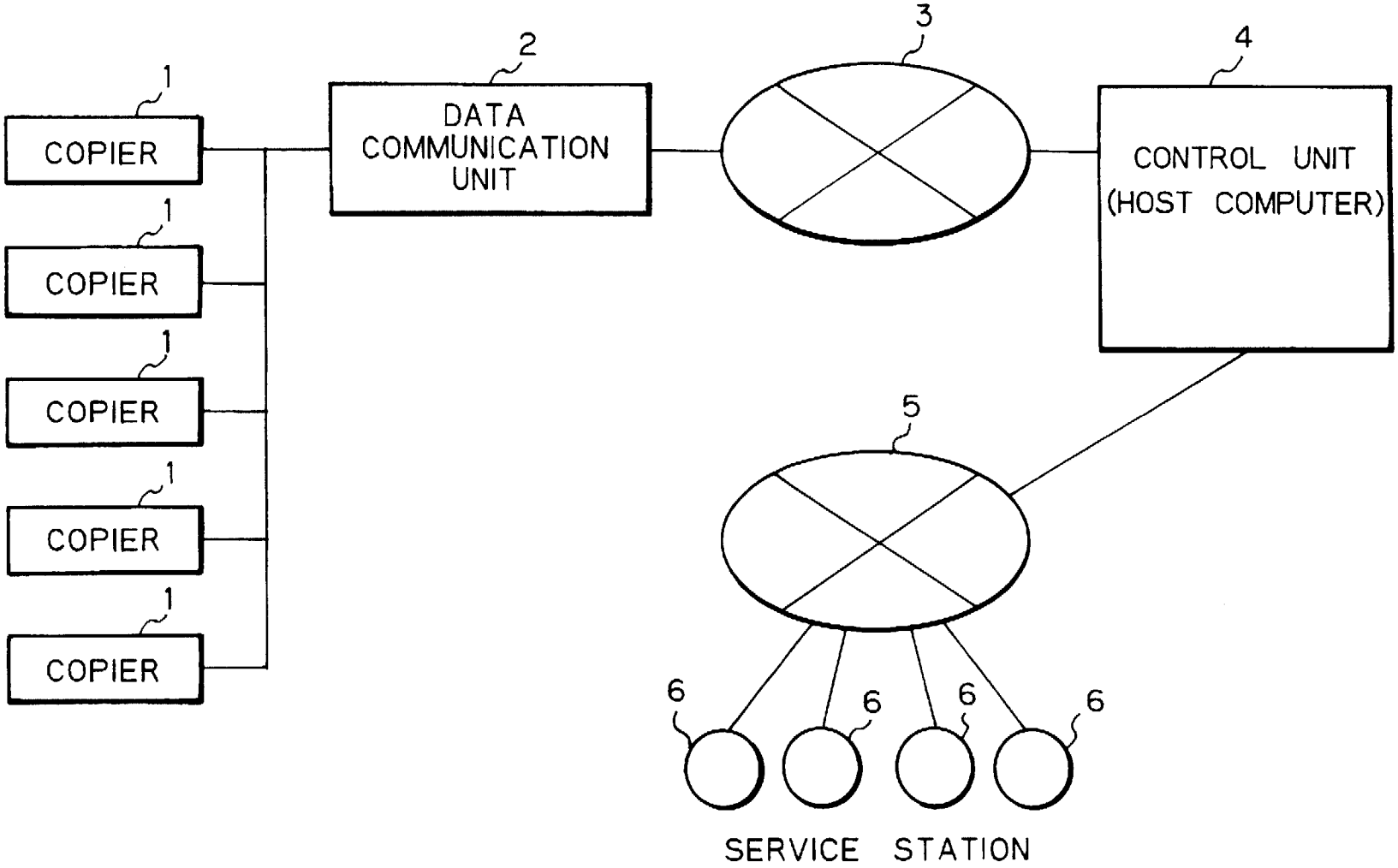
FIG. 2 is a block diagram showing the service system in accordance with the present invention.

Referring to FIG. 2 of the drawings, an image forming apparatus service system embodying the present invention is shown. As shown, the service system includes a number of copiers, printers, facsimile apparatuses or similar image forming apparatuses 1 each being situated at a particular user's station. The apparatuses 1 will be assumed to be copiers by way of example. A control center includes a control unit or host computer 4. All the copiers 1 are connected to the control unit 4 by a data communication unit 2 and a communication network 3. Terminal units 6 are each located at a particular service station and connected to the control unit 4 by a communication network 5. The communication networks 3 and 5 may each be implemented by a public telephone network.

Each copier 1 in accordance with the present invention is capable of detecting paper jams occurred on a paper transport path on a location-by-location basis. The copier counts or resets jam information location by location. When the number of jams occurred at any location reaches a predetermined value, the copier 1 sends to the control unit 4 jam alarm information indicating that the probability of frequent jam at the above location is high.

The control unit 4 receives information from the individual copier 1, stores them, and analyzes them so as to estimate errors and the need for a serviceman. If any one of the copiers 1 needs a serviceman, the control unit 4 automatically sends necessary information to one of the terminal units 6 supervising the copier 1 in question.

The terminal units 6 are minicomputers or personal computers located at the service stations. The terminal units 6 each stores information received from the control unit 4, informs a serviceman of the user's station needing repair, and displays the conditions of the copier 1 in question.

Figure 3:
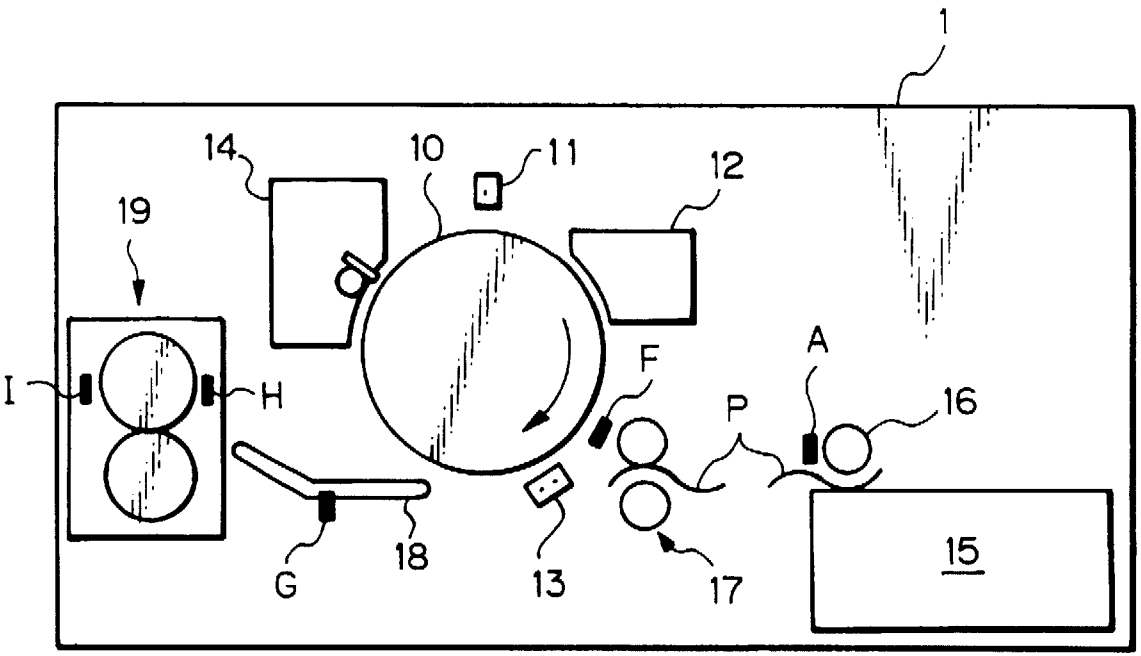
FIG. 3 shows sections included in the copier of FIG. 1 and joining in image formation and sensors arranged along a paper transport path.

FIG. 3 shows various sections included in each copier 1 and joining in image formation and a number of sensors arranged along a paper transport path. As shown, a photoconductive drum 10 is positioned at substantially the center of the copier 1. Arranged around the drum 10 are a main charger 11, a developing unit 12, a transfer charger 13, and a cleaning unit 14. While the drum 10 is in rotation, the main charger 11 uniformly charges the surface of the drum 10. A scanner and an exposing device, not shown, optically scan the charged surface of the drum 10 in order to electrostatically form a latent image thereon. The developing unit 12 deposits toner on the latent image and thereby produces a corresponding toner image. A pick-up roller 16 feeds papers P from a paper tray 15 toward a registration roller pair 17 one by one. The roller pair 17 stops the paper P and then drives it toward an image transfer station adjoining the drum 10 at a preselected timing. The transfer charger 13 transfers the toner image from the drum 10 to the paper P at the image transfer station. An endless belt or similar conveyor 18 conveys the paper P with the toner image to a fixing unit 19. After the toner image has been fixed on the paper P by the fixing unit 19, the paper P is driven out of the copier 1. After the image transfer, the cleaning unit 14 cleans the surface of the drum 10 to thereby prepare it for the next image formation.

Sensors, e.g., reflection type or transmission type photosensors responsive to the paper P are arranged along the paper transport path. Specifically, a paper feed sensor A is located at the output side of the pick-up roller 16. A registration sensor F is located at the output side of the registration roller pair 17. A transport sensor G is located at the conveyor 18. A fixation sensor H and a paper discharge sensor I are respectively located at the inlet and the outlet of the fixing unit 19. By monitoring the outputs of such sensors and paper transport times, it is possible to detects paper jams and the locations where they occurred. When a paper jam occurs, it is displayed on an operation and display panel while the copying operation is interrupted, as has been customary with a copier.

Figure 1A:
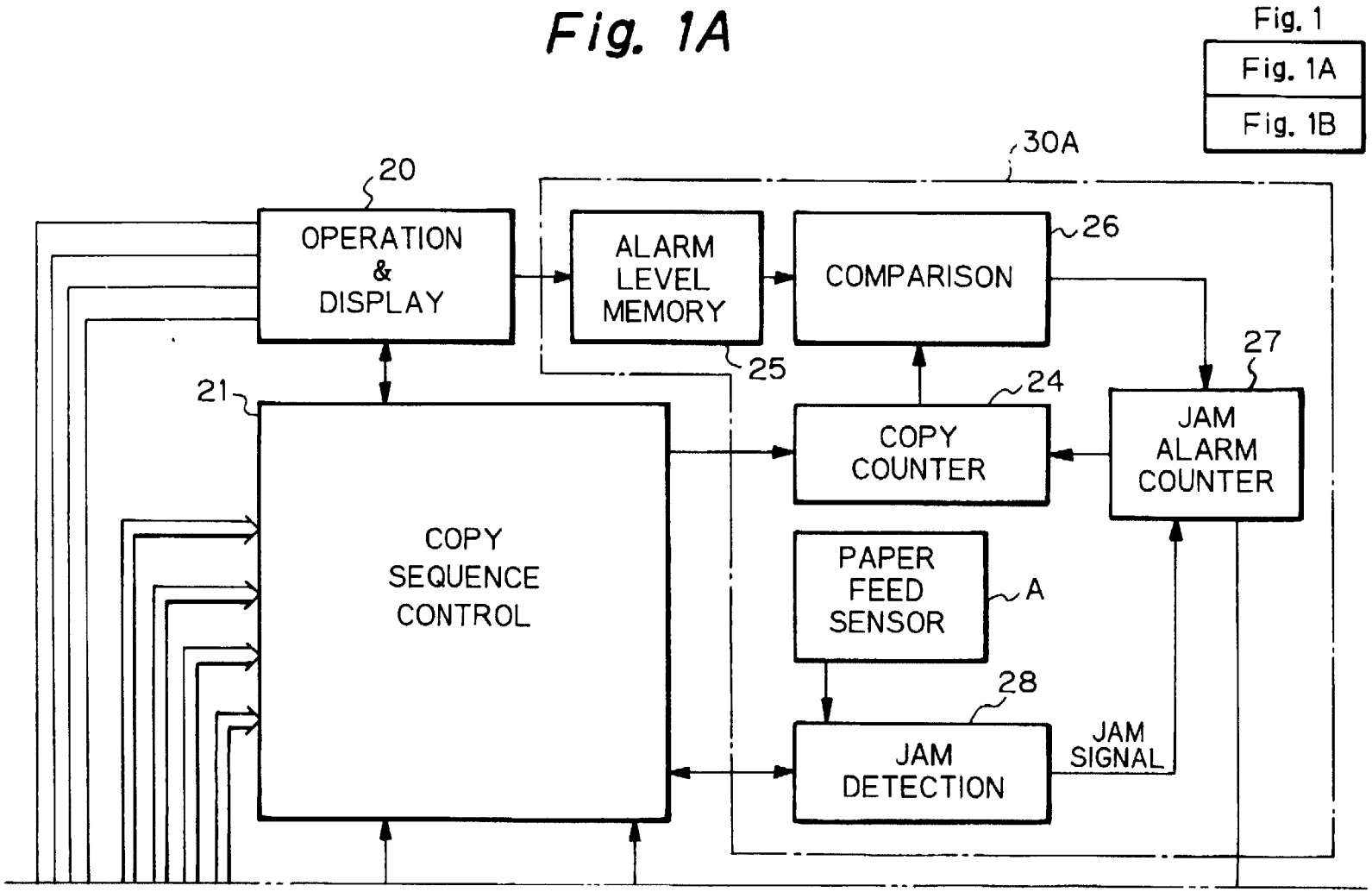
FIG. 1 is a block diagram schematically showing a copier embodying the present invention and included in a service system shown in FIG. 2.
Figure 1B:
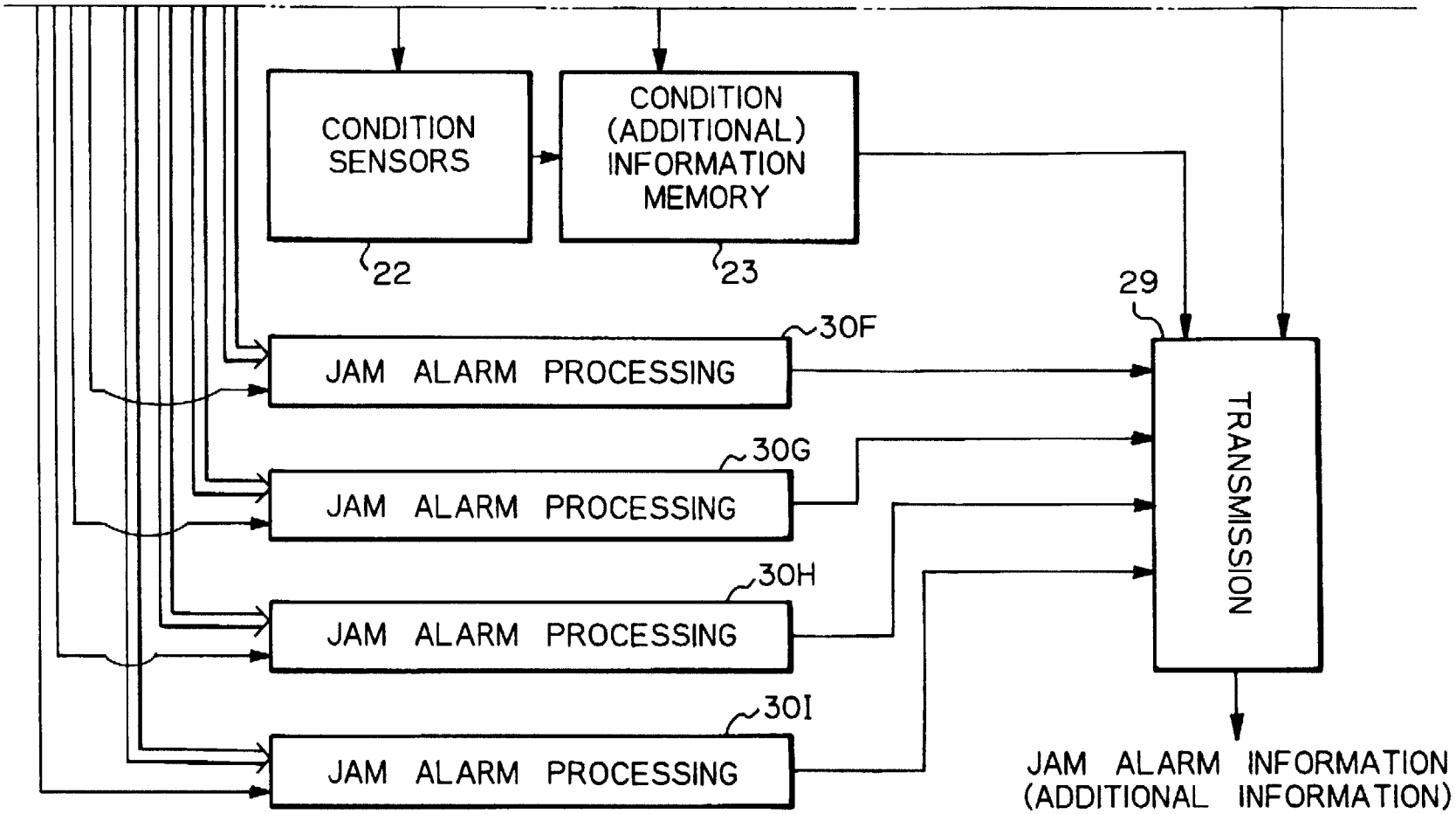

Referring to FIG. 1, a control system included in the copier 1 has an operation and display 20 including various kinds of input keys or switches arranged on the operation and display panel and including a start key and numeral keys.

The operation and display 20 allows standard jam values to be input thereon location by location. Each standard jam value is a numerical value corresponding to the number of copies and is used as a reference value for determining whether or not a jam occurred is of unusual nature. It is possible to set a particular standard jam value for each jam alarm counter 27, which will be described, taking account of the user characteristic (including the user's sentiment factor and environment factor). Alternatively, default values particular to the copier 1 and stored beforehand may be corrected. Further, any desired reference value with which the jam alarm counter 27 determines whether or not to output jam alarm information can be set.

A copy sequence controller 21 controls the copy sequence of the copier 1 with a microcomputer. When the start key included in the operation 20 is pressed, the copy sequence controller 21 sequentially controls the various sections shown in FIG. 2, and the scanner and exposing device, motors, clutches, high-tension power sources and so forth, not shown, thereby controlling the operation for copying a document on the paper P. At the same time, the controller 21 controls the entire copier 1.

Condition sensors 22 are responsive to temperature (and humidity) inside the copier 1, fixing temperature, the surface temperature of the drum 10, the presence/absence of supplies, and so forth. A condition information memory 23 stores the conditions of the copier 1 represented by the outputs of the copy sequence controller 21 and those of the sensors 22. The conditions to be stored in the memory 23 are information to be added to the jam alarm information, as will be described later. These additional information include the total count (TC) of a total copy counter built in the copy sequence controller 21 for counting the cumulative number of copies, the conveying time of the pick-up roller 16, fixing temperature, and image density.

A copy counter 24 receives a count signal from the copy sequence controller 21 every time a single copying operation (paper discharge) ends. This allows the copy counter 24 to count the number of copies continuously output without any jam.

An alarm level memory 25 stores the standard jam value or alarm level assigned to a first location (where the sensor A is positioned) and input beforehand or input on the operation and display 20. The alarm level is representative of the number of copies continuously produced without any jam and necessary for determining whether or not the jam information is valid and for resetting a jam alarm count. The memory 25 is implemented as a nonvolatile memory.

A comparison 26 compares the number of copies and alarm level received from the copy counter 24 and alarm level storage 25, respectively. When the number of copies reaches the alarm level, the comparison 26 feeds a coincidence signal to the jam alarm counter 27.

When the jam alarm counter 27 receives a jam signal from a jam detection 28, it increments the jam alarm count by 1 (one), i.e., counts the jam information and sends a reset signal to the copy counter 24 in order to reset it. Further, if the jam alarm count is not zero when the coincidence signal is fed from the comparison 26 to the counter 27, the counter 27 resets the jam alarm count, i.e., clears it to zero. When the jam alarm count reaches a preselected reference value, e.g., "10", the counter 27 delivers to a transmission 29 jam alarm information showing that the probability of frequent jam is high. At the same time, the counter 27 delivers a reset signal to the copy counter 24 in order to reset it.

While a copying operation is performed under the control of the copy sequence control 21, the jam detection 28 monitors the output signal of the paper feed sensor A in relation to the paper transport time, thereby determining whether or not a jam has occurred. Specifically, assume the sensor A does not sense the paper P within a preselected period of time since the beginning of the paper feed, or that it continuously senses the paper P for more than a preselected period of time. Then, the jam detection 28 determines that a jam has occurred, and then feeds a jam signal relating to the first location to the jam alarm counter 27. Also, in response to the jam signal, the copy sequence control 21 interrupts the copying operation and displays the occurrence and location of the jam on the operation and display 20. Usually, the operator watching the display removes the jamming sheet in order to restore the normal state.

The paper feed sensor A, jam detection 28, copy counter 24, alarm level memory 25, comparison 26 and jam alarm counter 27 constitute a jam alarm processing section 30A in combination.

Jam alarm processing sections 30F, 30G, 30H and 30I are also connected between the copy sequence controller 21 and the transmission 29 and respectively assigned to a second, a third, a fourth and a fifth location. The processing sections 30F–30I are identical with the processing section 30A except that they include the registration sensor F, transport sensor G, fixing sensor H, and paper discharge sensor I, respectively.

The jam detection 28 of the jam alarm processing section 30F monitors the output signal of the registration sensor F in relation to the paper transport time, thereby determining whether or not a jam has occurred. Specifically, assume that the registration sensor F does not sense the paper P within a preselected period of time since the sensing of the paper P by the paper feed sensor A, or that it continuously senses the paper P for more than a preselected period of time. Then, the jam detection 28 determines that a jam has occurred, and then delivers a jam signal relating to the second location to the jam alarm counter 27 disposed in the processing section 30F. The rest of the construction is identical with the processing section 30A.

Likewise, the jam detection 28 included in each of the jam alarm processing sections 30G, 30H and 30I monitors the output of the transport sensor G, fixing sensor H or paper discharge sensor I in relation to the paper transport time, thereby determining whether or not a jam has occurred. Specifically, assume that the sensor G, H or I does not sense the paper P within a preselected period of time since the sensing of the paper P by the upstream sensor, or that it continuously senses the paper P for more than a preselected period of time. Then, the jam detection 28 determines that a jam has occurred, and then delivers a jam signal relating to the associated location to the jam alarm counter 27. The rest of the construction is identical with the processing section 30A.

Also, in response to the jam signal output from any one of the jam alarm processing sections 30F–301, the copy sequence controller 21 interrupts the copying operation and displays the occurrence and location of the jam on the operation and display 20. Usually, the operator watching the display removes the jamming sheet in order to restore the normal state.

If desired, the output signals of the sensors A and F–I may be directly input to the copy sequence control 21. In such a case, common jam detecting means capable of detecting jams location by location will be disposed in the copy sequence controller 21.

Assume that the jam alarm counter 27 of any one of the jam alarm processing sections 30A and 30F–30I has output jam alarm information. Then, the transmission 29 sends jam alarm information representative of the location to the control unit 4 via the data communication unit 2 and communication network 3, FIG. 2, together with the condition information output from the condition information memory 23 and an identification (ID) assigned to the copier. Further, when a serviceman call, sensor error or similar unusual phenomenon occurs, information representative of such a phenomenon may also be sent to the control unit 4.

Hereinafter will be described valid information and invalid information relating to the jam alarm. The jam alarm counter 27 assigned to the respective location counts jam signals output from the associated jam detection 28. When the count of the counter 27 reaches a preselected reference value, the counter 27 outputs jam alarm information, as stated earlier. However, assume that before the count of the counter 27 reaches its reference value, the count of the copy counter 24, i.e., the number of copies continuously output without any jam has reached the standard jam value stored in the alarm level memory 25. Then, the counter 27 resets its count and does not output jam alarm information. This will be described more specifically with reference to FIG. 4.

Figure 4:
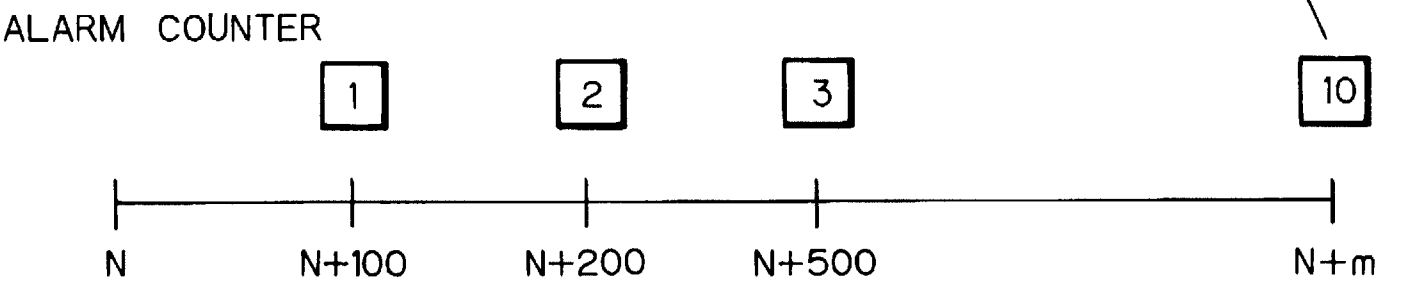
FIG. 4 demonstrates a specific operation of a jam alarm counter included in the copier of FIG. 1.

The condition for the count of the jam alarm counter 27 to be incremented by 1 by a jam signal is that the count be smaller than the standard jam value or alarm level. As shown in FIG. 4, assume that the standard jam value is 1,000 papers. Then, the counter 27 is incremented when a jam is detected before the number of copies increases from N to N+1,000. If a jam is again detected before other 1,000 copies are produced, the counter 27 is again incremented.

In the specific case shown in FIG. 4, jams are detected when N+100 copies are produced, when N+200 copies are produced, and when N+500 copies are produced, so that the counter 27 is sequentially incremented to "1", "2" and "3". In this manner, jam information incrementing the counter 27 are valid information. Specifically, when a value including some cause of error is repeatedly input to the counter 27 a preselected number of times (ten times in FIG. 4) assigned to a given location, it is determined that the frequent jam ascribable to some cause of error is quite probable. As a result, jam alarm information is output and sent to the control unit 4. In FIG. 4, the counter 27 reaches the reference value "10" when N+m copies are produced, causing the jam alarm information to be sent to the control unit 4.

However, it may occur that after the counter 27 has been incremented to "3" due to three consecutive jams, as shown in FIG. 4, the cause of error happens to be naturally removed. For example, dust gathered in a paper feed clutch may be automatically removed from the clutch. Then, the number of copies produced exceeds the standard jam value. As a result, it is determined that the cause of error has been removed, and the future probability of frequent error is low. It is therefore possible to determine that the current data of the counter 27 is different from the future cause of error and has no influence thereon. In this sense, such data are invalid. In this case, the counter 27 is reset to cancel the invalid information. This successfully enhances the accuracy of jam alarm information.

As stated above, in the illustrative embodiment, the jam alarm processing sections each including the jam alarm counter are each assigned to a particular location. When a jam occurs at some location, the jam alarm counter associated with that location is incremented by 1 by valid jam alarm information if the number of copies is between the previous count (or reset count) and the standard jam value. However, if the number of copies is between the previous count (or reset count) and a value greater than the standard jam value, the counter 27 is reset because the alarm information is invalid. Such a procedure is repeated in order to count only the latest valid jams. When the counter 27 reaches the standard jam value (e.g. N=10), jam alarm information showing that a jam will frequently occur at the above location in the near future is generated. The jam alarm information is sent to the control unit 4 via the transmission 29 together with other information.

The reference value for the generation of the jam alarm information may also be implemented as default values particular to the copier 1 location by location. Alternatively, the reference values may be input on the operation 20 like the standard jam values or alarm levels, taking account of the user characteristic.

As to the location-by-location standard jam values, there may be set independently values for determining whether or not the jam alarm counters 27 should count jam information, and values for determining whether or not to reset the counts of the counters 27.

Figure 5A:
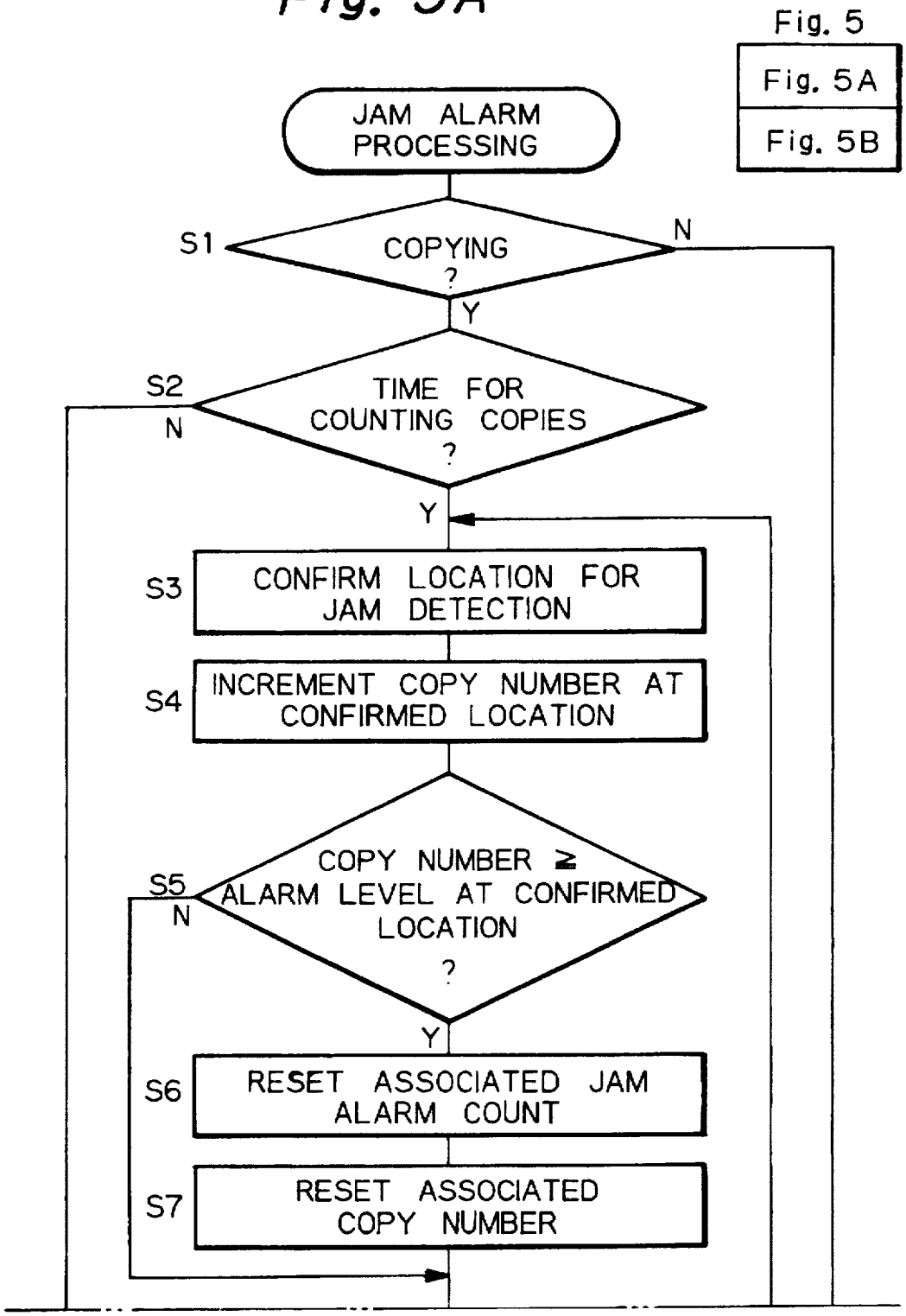
FIG. 5 is a flowchart demonstrating specific jam alarm processing to be executed by the copier of FIG. 1.
Figure 5B:
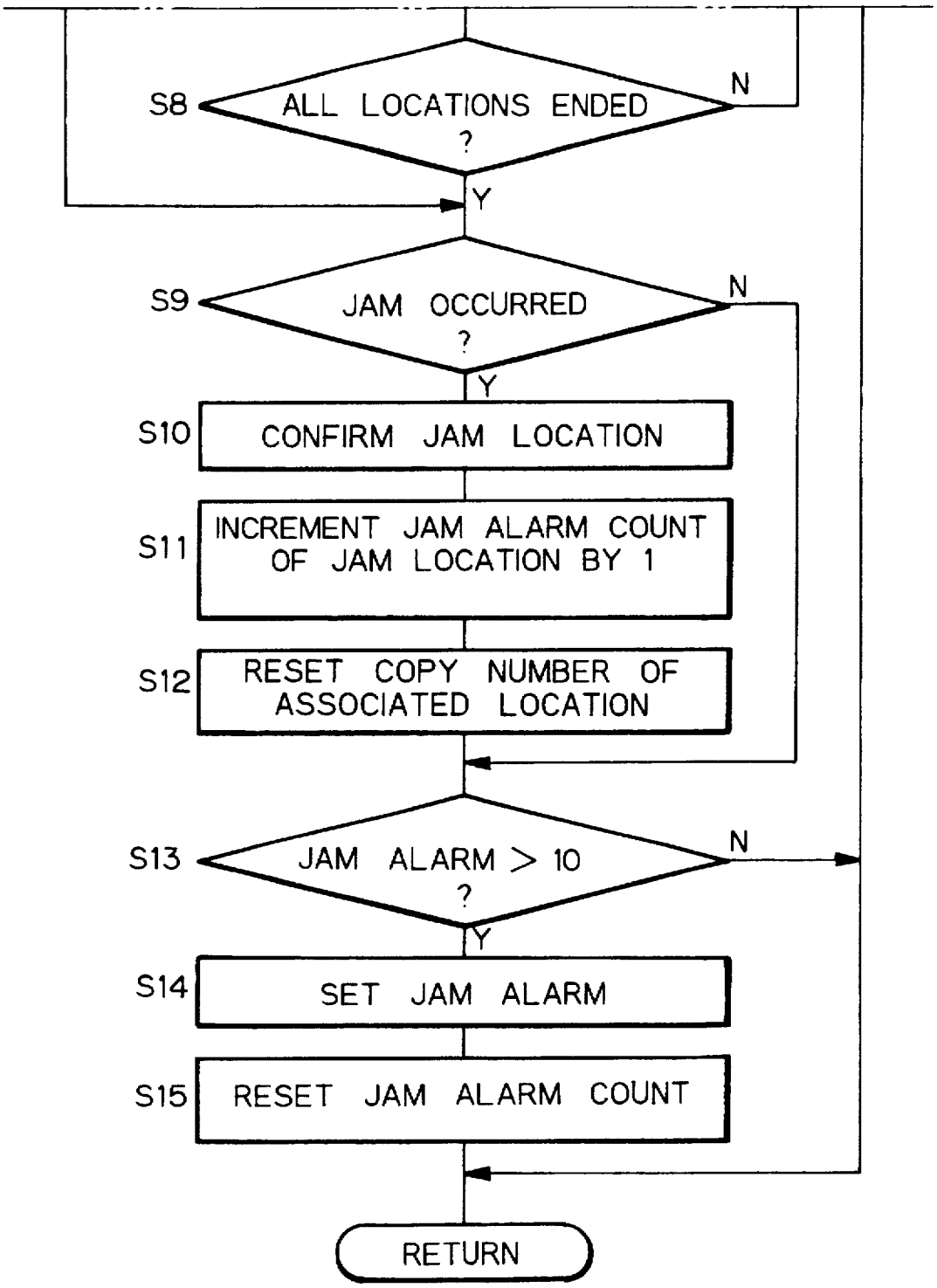

A reference will be made to FIG. 5 for describing the jam alarm processing more specifically. First, whether or not the copier 1 is performing a copying operation is determined (step S1). The routine shown in FIG. 5 is executed only when the answer of the step S1 is positive (Y). If the answer of the step S1 is negative (N), the program simply returns to a main routine, not shown. If the answer of the step S1 is Y, whether or not the time for counting the number of copies has been reached is determined (step S2). If the answer of the step S2 is Y, the location for detecting jams is confirmed (step S3). Then, the number of copies at the above location is incremented by 1 (step S4). This is followed by a step S5. If the answer of the step S2 is N, the step S2 is followed by a step S9. In the step S5, the number of copies counted and the alarm level of the above location are compared. If the number of copies is greater than or equal to the alarm level (e.g. 1,000) (Y, step S5), the jam alarm count of the location is reset (step S6). Then, the number of copies of the location is reset (step S7). If the answer of the step S5 is N or after the step S7, whether or not the steps S3–S7 have been fully executed for all the locations corresponding to the sensors A and F–I is determined (step S8). If the answer of the step S8 is N, the program returns to the step S3 in order to execute the above procedure for the next location.

If the answer of the step S8 is Y, whether or not a jam has occurred is determined (step S9). If the answer of the step S9 is Y, the location where the jam has occurred is confirmed (step S10). Then, the jam alarm count of the above location is incremented by 1 (step S11), and the number of copies of the same location is reset (step S12). This is followed by a step S13. If the answer of the step S9 is N, the step S13 is directly executed.

In the step S13, whether or not the jam alarm count of the above location has reached the reference value (e.g. "10") is determined. If the answer of the step S13 is Y, jam alarm information and additional information are sent together with the copier ID (step S14). Subsequently, the jam alarm count is reset (step S15). If the answer of the step S13 is N, the routine simply ends.

With the above procedure, it is possible to detect, with a relatively simple construction and a small size inexpensive memory, the high probability of future frequent jam location by location with accuracy, and to send jam alarm information to the control unit 4. This obviates the transmission of wasteful information to the control unit 4 and thereby saves communication cost, while facilitating the decision of the control unit 4 as to whether or not to send a serviceman.

Figure 6:
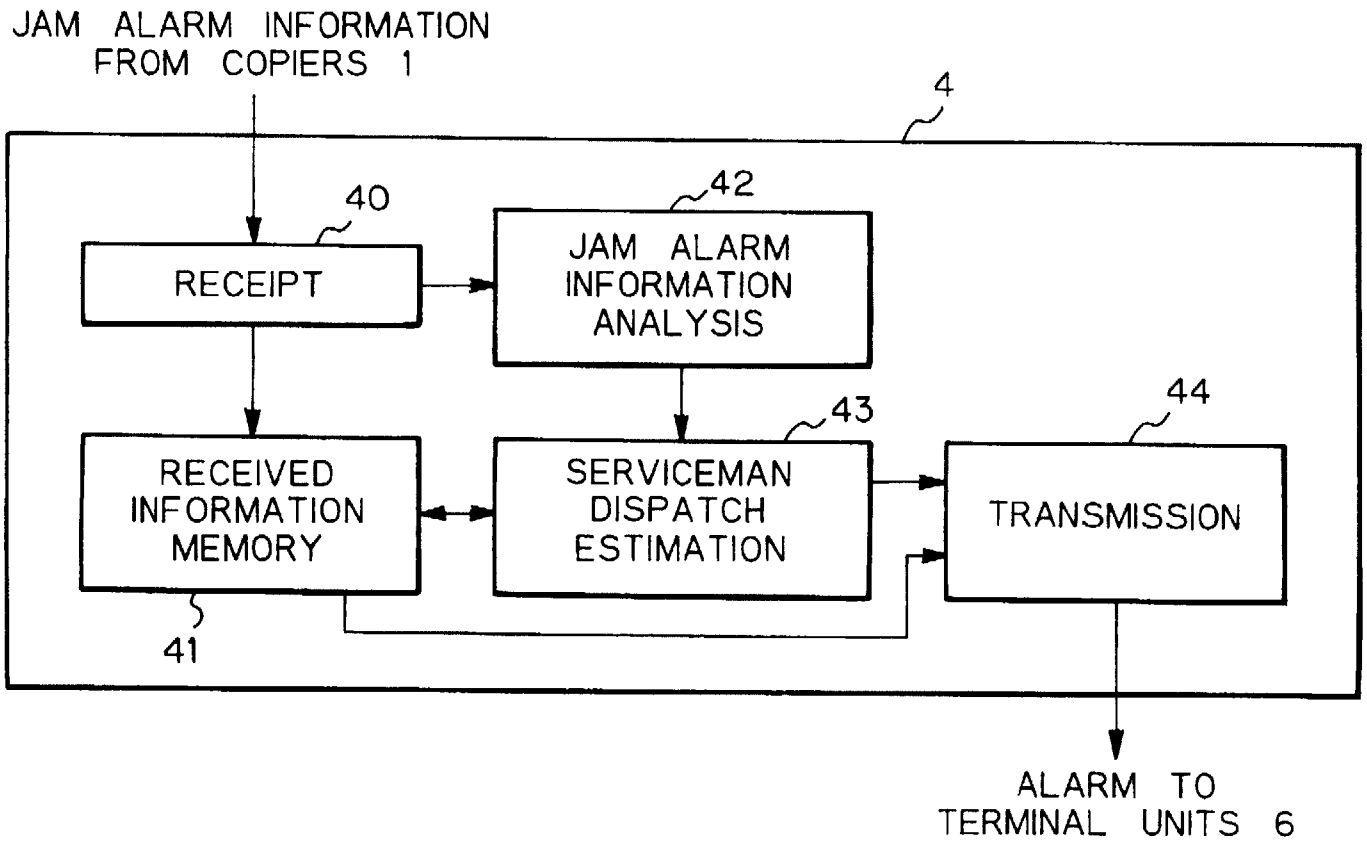
FIG. 6 is a block diagram schematically showing a specific configuration of a control unit shown in FIG. 2.

FIG. 6 shows a specific configuration of the control unit or host computer 4. As shown, the control unit 4 has a receipt 40, a received information memory 41, a jam alarm information analysis 42, a serviceman dispatch estimation 43, and a transmission 44. The receipt 40 receives the jam alarm information (identification of a location where frequent jam is quite probable) and additional information (total copy number, serviceman call, sensor errors and other unusual phenomena). The received information are sequentially written to the memory 41 while being distinguished on the ID basis.

Every time jam alarm information is received by the receipt 40, the jam alarm information analysis 42 analyzes it as well as the information stored in the memory 41 and associated with the copier 1 in question, thereby performing remote diagnosis including error estimation. In this case, on the receipt of the jam alarm information, the analysis 42 can immediately see that a jam will frequently occur at the location indicated by the information in the near future. Further, when serviceman call information, sensor error information or similar error information is received, the analysis 42 also determines that an error has occurred. In addition, when information representative of the total number of copies is also received, the analysis 42 may perform a decision as to an error or the time for maintenance, using the difference between the received total number and the last total number.

The serviceman dispatch estimation 43 determines whether or not a serviceman should be sent on the basis of the estimation or the result of diagnosis output from the analysis 42. If a serviceman should be sent, the estimation 43 delivers serviceman request information and, among the information stored in the memory 42, information necessary for a service to the transmission 44. The transmission 44 sends such information to one of the terminal units 6 covering the copier 1 in question.

Figure 7:
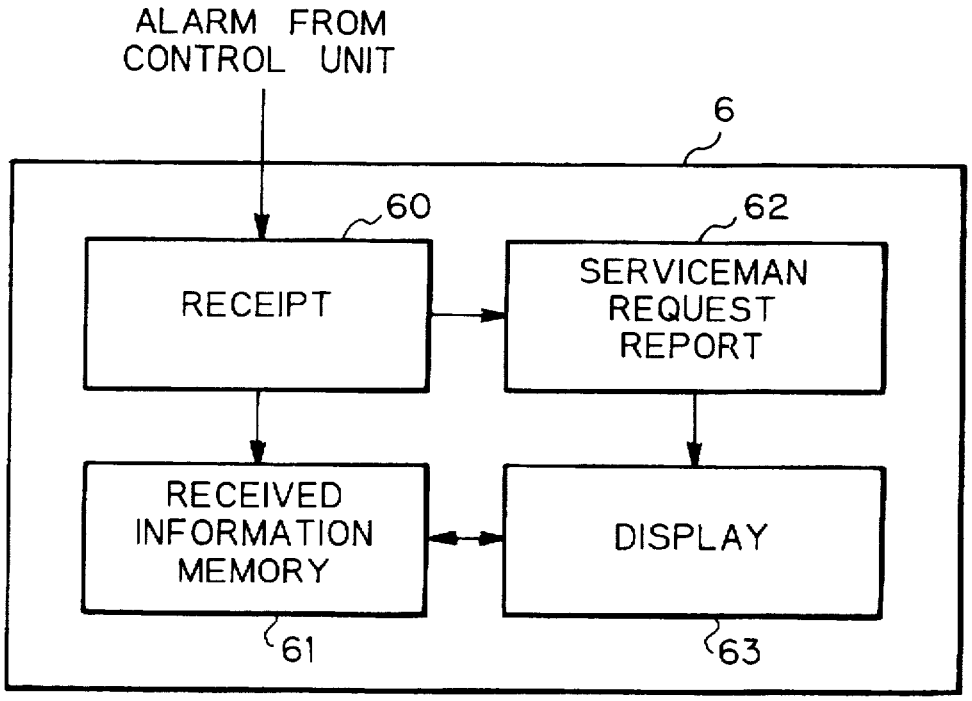
FIG. 7 is a block diagram schematically showing a terminal unit also shown in FIG. 2.

FIG. 7 shows a specific configuration of one of the terminal units 6. As shown, the terminal unit 6 has a receipt 60, a received information memory 61, a serviceman request report 62, and a display 63. The receipt 61 receives the serviceman request and information necessary for a service from the control unit 4. A memory 61 stores the received information. The request report 62 reports the serviceman request received by the receipt 60. The display 63 displays the received information, i.e., jam alarm information.

In the system described above, the control unit 4 can easily determine, based on the jam alarm information received from the copiers 1, a particular location of a particular copier where a jam will frequently occur in the near future. Then, the control unit 4 sends serviceman request information and information necessary for a service to one of the terminal units 6 covering the above copier.

On receiving the information from the control unit 4, the terminal unit 6 informs a serviceman standing by there of the serviceman request via a buzzer or a lamp. At the same time, the terminal unit 6 informs the serviceman of the particular copier and its particular position where a jam will frequently occur in the near future, either visually or auditorily. This allows the serviceman to maintain the copier immediately and accurately before frequent jam actually occurs in the copier.

While the present invention has been described in relation to a copier, it is similarly applicable to other various kinds of image forming apparatuses using papers, e.g., printers, facsimile apparatuses and simple printers, and their service systems.

In summary, it will be seen that the present invention provides an image forming apparatus and a service system therefor which have various unprecedented advantages, as enumerated below.

(1) It is possible to detect, with a relatively simple construction and a small size inexpensive memory, the high probability of future frequent jam location by location with accuracy, and to send jam alarm information to a control unit. This obviates the transmission of wasteful information to the control unit and thereby saves communication cost, while facilitating the decision of the control unit as to whether or not to send a serviceman.

(2) The control unit can easily determine, based on the jam alarm information received from copiers, a particular location of a particular copier where a jam will frequently occur in the near future. Then, the control unit sends serviceman request information and information necessary for a service to one of a particular terminal units covering the above copier.

(3) On receiving the information from the control unit, the terminal unit informs a serviceman standing by there of the serviceman request via a buzzer or a lamp. At the same time, the terminal unit informs the serviceman of the particular copier and its particular position where a jam will frequently occur in the near future. This allows the serviceman to maintain the copier immediately and accurately before frequent jam actually occurs in the copier.

Various modifications will become possible for those skilled in the art after receiving the teachings of the present disclosure without departing from the scope thereof.

What is claimed is:

1. An image forming apparatus comprising:

a plurality of sensors each being located at a particular location on a preselected paper transport path;

jam detecting means for detecting a paper jam during image formation location by location on the basis of output signals of said plurality of sensors;

a plurality of storing means, each being assigned to a particular location, for storing a standard jam value corresponding to a number of papers which have undergone image formation to thereby determine whether or not jam information is valid;

a plurality of paper counting means, each being assigned to a particular location, for counting a number of papers which have continuously undergone image formation without any paper jam;

a plurality of jam alarm counting means, each being assigned to a particular location, for counting resulting jam information when said jam detecting means detects a paper jam which occurred at a location and if a count of an associated one of said paper counting means is smaller than said standard jam value assigned to said location, for resetting a count of jam information when the count of said paper counting means reaches said standard jam value assigned to said location before a next paper jam is detected at said location, and for generating, when the count of jam information reaches a preselected reference value, jam alarm information showing that a paper jam will frequently occur at said location in the near future; and jam alarm information transmitting means for transmitting jam alarm information generated by said plurality of jam alarm counting means to a control unit connected to said apparatus by a communication line.

2. An apparatus as claimed in claim 1, further comprising setting means for setting each of said standard jam values in a form of a value for determining whether or not any one of said plurality of jam alarm counting means should count the jam information, and a value for determining whether or not to reset the count of jam information.

3. An apparatus as claimed in claim 1, further comprising setting means for allowing a user of said apparatus to set said standard jam values by correcting values particular to and stored in said apparatus in accordance with a user characteristic.

4. An apparatus as claimed in claim 1, wherein said reference value comprises a plurality of reference values, said apparatus further comprising setting means for setting desired values as said reference values each being assigned to a particular location.

5. An apparatus as claimed in claim 1, wherein said jam alarm information transmitting means transmits, when a serviceman call, sensor error or similar unusual phenomenon occurs, information representative of the unusual phenomenon to said control unit.

6. In an image forming apparatus service system, a plurality of image forming apparatuses each being recited in any one of claims 1–5 are each situated at a particular user's station and connected to a control unit by a communication network for remote control, and said control unit is connected by a communication network to a plurality of terminal units each being situated at a particular service station.

7. A system as claimed in claim 6, wherein said control unit comprises:

storing means for sequentially storing said jam alarm information received from said plurality of image forming apparatuses;

analyzing means for analyzing said jam alarm information;

estimating means for determining, based on a result of analysis output from said analyzing means, an occurrence of an error and whether or not a serviceman should be sent; and transmitting means for transmitting a result of output from said estimating means to one of said plurality of terminal units covering the image forming apparatus in question.

8. A method of forming an image, comprising the steps of:

counting a first number of consecutively generated images which have been completed;

detecting a first jam;

incrementing a jam counter only when the first number of consecutively generated images which have been counted exceeds a first predetermined value;

counting a second number of consecutively generated images which have been completed;

detecting a second jam;

incrementing the jam counter only when the second number of consecutively generated images which have been counted exceeds the first predetermined value; and generating an alarm when the jam counter exceeds a second predetermined value.

9. A method as claimed in claim 8, further comprising:

setting, by a user, said first predetermined value.

10. A method as claimed in claim 8, further comprising:

setting, by a user, said second predetermined value.

11. A system for forming an image, comprising:

means for counting a first number of consecutively generated images which have been completed;

means for detecting a first jam;

means for incrementing a jam counter only when the first number of consecutively generated images which have been counted exceeds a first predetermined value;

means for counting a second number of consecutively generated images which have been completed;

means for detecting a second jam;

means for incrementing the jam counter only when the second number of consecutively generated images which have been counted exceeds the first predetermine value; and means for generating an alarm when the jam counter exceeds a second predetermined value.

12. A system as claimed in claim 11, further comprising:

a display comprising input keys for entering, by a user of said system, said first predetermined value.

13. A system as claimed in claim 11, further comprising:

a display comprising input keys for entering, by a user of said system, said second predetermined value.

14. An image forming apparatus, comprising:

at least one sensor located at a particular location on a preselected paper transport path, each of said at least one sensor generating a corresponding output signal;

a jam detecting device which detects a paper jam during image formation using said at least one sensor and the corresponding output signal;

at least one paper counter assigned to a particular location which counts a cumulative number of papers which have consecutively undergone image formation since said jam detecting device detected a paper jam;

at least one memory assigned to a particular location which stores a first preselected value corresponding to a number of papers which have undergone image formation, said first preselected value being a threshold number of jams which when exceeded indicates that a probability of a frequent jam exists;

at least one jam counter assigned to a particular location which counts paper jams which have occurred; and at least one circuit assigned to a particular location which increments, if said jam detecting device detects a paper jam before said cumulative number of said at least one paper counter equals said first preselected value, a count of said at least one jam counter, and which changes a count of said at least one jam counter when said cumulative number of said at least one paper counter equals said first preselected value.

15. An apparatus as claimed in claim 14, further comprising:

a control unit connected to said apparatus by a communication cable, said control unit receives alarm information transmitted by said apparatus when a count of paper jams counted by said at least one jam counter equals a second preselected value.

16. An apparatus as claimed in claim 14, wherein said at least one circuit resets a count of said at least one jam counter.

17. A method of forming an image, comprising the steps of:

detecting a paper jam during image formation;

counting a cumulative number of papers which have consecutively undergone image formation since a paper jam was detected by the step of detecting;

storing, in a memory, a first preselected value corresponding to a predetermined number of papers which have undergone image information, said first preselected value being a threshold number of jams which when exceeded indicates a probability of a frequent jam exists;

incrementing a jam counter only when a jam is detected before the cumulative number of papers exceeds said first preselected value; and changing said jam counter only when the cumulative number of papers exceeds said first preselected value.

18. A method as claimed in claim 17, further comprising the step of:

generating an alarm when the jam counter exceeds a second predetermined value.

19. A method as claimed in claim 17, further comprising the step of:

resetting said jam counter.

* * * * *